US012257516B2

(12) United States Patent
Klanjscek et al.

(10) Patent No.: US 12,257,516 B2
(45) Date of Patent: Mar. 25, 2025

(54) AUTOMATED BALL EXCHANGE AND SELECTION FOR ROULETTE GAME CYCLE OPTIMIZATION

(71) Applicant: Interblock d.o.o., Las Vegas, NV (US)

(72) Inventors: Mirko Klanjscek, Ljubljana (SI); Peter Kroselj, Bled (SI)

(73) Assignee: INTERBLOCK D.O.O., Las Vegas, NV (US)

( * ) Notice: Subject to any disclaimer, the term of this patent is extended or adjusted under 35 U.S.C. 154(b) by 213 days.

(21) Appl. No.: 18/317,578

(22) Filed: May 15, 2023

(65) Prior Publication Data

US 2024/0261669 A1 Aug. 8, 2024

Related U.S. Application Data

(60) Provisional application No. 63/483,228, filed on Feb. 3, 2023.

(51) Int. Cl.

| | |
|---|---|
| ***A63F 5/00*** | (2006.01) |
| ***A63F 7/24*** | (2006.01) |
| ***A63F 7/34*** | (2006.01) |

(52) U.S. Cl.

CPC ..... *A63F 5/0005* (2013.01); *A63F 5/0088* (2013.01); *A63F 7/2409* (2013.01); *A63F 7/34* (2013.01); *A63F 2007/343* (2013.01); *A63F 2007/345* (2013.01)

(58) Field of Classification Search

CPC .... A63F 5/0005; A63F 5/0088; A63F 7/2409; A63F 7/34; A63F 2007/345

See application file for complete search history.

(56) References Cited

U.S. PATENT DOCUMENTS

| | | | | |
|---|---|---|---|---|
| 3,810,535 | A | 5/1974 | Phipps | |
| 2007/0246883 | A1 | 10/2007 | Cudlipp | |
| 2013/0134672 | A1 | 5/2013 | Okuaki et al. | |
| 2017/0256121 | A1* | 9/2017 | Burgstaller | G07F 17/322 |
| 2018/0082514 | A1 | 3/2018 | Okuaki et al. | |
| 2019/0108712 | A1 | 4/2019 | Bergant et al. | |
| 2021/0362037 | A1* | 11/2021 | Kulhanek | G07F 17/3202 |

FOREIGN PATENT DOCUMENTS

| | | | |
|---|---|---|---|
| CN | 111447978 | A | 7/2020 |
| WO | WO 2019/071224 | A1 | 4/2019 |

OTHER PUBLICATIONS

International Patent Application No. PCT/US2024/014052; Int'l Search Report and Written Opinion; dated May 16, 2024; 9 pages.
International Patent Application No. PCT/US2024/014052; Int'l Preliminary Report on Patentability; dated Jan. 22, 2025; 24 pages.

* cited by examiner

*Primary Examiner* — Jay Trent Liddle
(74) *Attorney, Agent, or Firm* — BakerHostetler

(57) ABSTRACT

A roulette machine having a launch device including an automatic ball-change device is described. The ball-change device includes a rotatable main wheel comprising a plurality of pockets, and a rotatable switch wheel switching between an open position and a closed position. The main wheel receives and stores a plurality of roulette balls for future use and facilitates changing of a current game ball and, with the switch wheel, delivering the roulette ball to a launch start position or other desired output. The main wheel and the switch wheel may be independently rotatable, and coordinate with one or more sensors to determine a timing and delivery of a specifically-selected game ball to start a game cycle.

24 Claims, 12 Drawing Sheets

AUTOMATED BALL EXCHANGE AND SELECTION FOR ROULETTE GAME CYCLE OPTIMIZATION

CROSS-REFERENCE TO RELATED APPLICATIONS

The present application claims priority to Provisional Application No. 63/483,228, filed Feb. 3, 2023, which is incorporated herein by reference.

BACKGROUND INFORMATION

Roulette is a popular wagering game played in casinos and other gaming establishments. In mechanical versions of the game (versus video generated), a roulette ball is launched into an angled annular track encircling a spinning roulette wheel. The roulette ball continues to rotate around the annular track in an opposite direction of the spinning roulette wheel creating friction between the roulette ball and the annular track. The friction created between the roulette ball and the annular track causes the ball to lose momentum. Upon losing sufficient momentum, the roulette ball exits the annular track and follows a spiraling path towards the roulette wheel.

As it follows the spiraling path, the roulette ball may engage with one or more of the ball stops (or canoes) intervening between the annular track and the roulette wheel, causing the ball to jump about. Eventually the roulette ball comes to rest in one of the numerous equally-spaced ball slots located along a circumference of the roulette wheel. Each ball slot among the equally-spaced ball slots is isolated from adjacent ball slots by separators positioned radially outward and corresponds to a particular number and color. The particular number represents a result for the game cycle that began when the roulette ball was launched.

As the roulette ball comes to rest, a marker (or dolly) is placed on an area of a felt betting area (or layout) identifying the particular number and color corresponding to the ball slot in which the roulette ball came to rest. Winning and losing bets for that game cycle to be placed on the felt betting area are then determined according to the result. Once the losing bets are collected and the winning bets are paid, a new game cycle starts.

In addition to causing the roulette ball to lose momentum, the friction between the roulette ball and the annular track may also erode some material from the annular track. That material eroded from the annular track and/or the ball becomes dust within the roulette wheel and the annular track. Another opportunity for the creation and dispersion of dust arises any time the roulette ball engages with a ball stop. As subsequent balls are launched into the angled track, interaction between the dust and subsequent roulette balls may impact a later game cycle.

For example, randomization of the later game cycle's result may be reduced by interaction with the dust. Also, subsequent roulette balls may rotate slower around the annular track, which increases game cycle times and further reduces randomization. At some point, dust generated by the friction renders the roulette table aesthetically displeasing, which negatively impacts the players' experience. The dust may also slow down game play cycles, thereby making the roulette table less productive. Furthermore, removing the dust creates maintenance downtime during which the roulette table is unavailable for gameplay.

While seemingly straightforward as far as games are concerned, new players to roulette can find all of the different types of possible bets confusing. Bets can be placed on "red/black" (all red or black numbers and excluding 0 and 00), on "even/odd" (all even or odd numbers and excluding 0 and 00), on "low/high" numbers 1-18 or numbers 19-36, on "dozen" or "third" (1-12, 13-24 or 25-36, on "column" (all numbers in one of three columns when the table is viewed from its end), on "straight up" (any single number), on "0" or "00" (some tables only use "0"), on "row" (0 and 00), on "top line" or "basket" (0, 00, 1, 2 and 3), on "six line" (any six numbers from two horizontal rows), on "split" (any two adjoining numbers vertical or horizontal), on "street" (any three numbers horizontal, such as 1, 2, 3 or 4, 5, 6, etc.), and on "corner" (any four adjoining numbers in a block, such as 1, 2, 4, 5 or 17, 18, 20, 21, etc.). It can take significant time for players to place bets in all of these different ways, which forces dealers to push players to finish bets, or if a machine is being used a timer to be employed, which can frustrate players.

Additional delays may be introduced due to inefficiencies related to ball launches to start each roulette game. In manual setups, a ball may be physically dropped or launched into the angular track. However, to maintain consistency and randomization, many roulette systems utilize a machine-based or automatic launching system. Some systems utilize magazines, which require balls to be launched in sequential order. As such, random selection of balls within the magazine cannot occur, and ball placement within the loader must be intentional since the order cannot change. This may lead to unintentional delays, e.g., to manually reorder balls within the magazine, and errors in gameplay, e.g., if an unintended or undesired ball from the magazine is launched.

Moreover, to refill the magazine, balls must be filled in one by one. Since many magazines rely on gravity, with at least one pocket aligning with a hole, loading multiple balls may cause more than one ball to drop below into the launch point and cause jams or other operational errors. Extra caution and manual supervision are often required to ensure accurate ball position and placement into loading systems. However, such actions are inefficient and can further delay gameplay.

TECHNICAL FIELD

The present disclosure relates generally, but not exclusively, to the field of gaming, particularly roulette gaming.

SUMMARY

An embodiment is directed to automated ball-change devices and magazines usable in roulette gaming systems. In some embodiments, an automated ball-change device may include a rotatable main wheel and a rotatable switch wheel. The rotatable main wheel may be a ball magazine, and include a plurality of pockets, each configured to receive and allow one roulette ball to pass through. The rotatable switch wheel may be positioned beneath the switch wheel and include a solid top plate and a through hole. A base plate may be positioned between the main wheel and the switch wheel. The base plate may include an open portion beneath a position of a first pocket of the main wheel, and a solid portion positioned beneath the remaining pockets. During rotation of the main wheel, a single pocket will align with the open portion, while the remaining pockets will be positioned over the solid portion. The solid portion prevents roulette balls from passing through a pocket.

In various embodiments, rotating the switch wheel may cause a switch between an open position and a closed position. In the closed position, the solid top plate blocks the open portion of the base plate and prevents the roulette ball from passing. In the open position, the through hole aligns with the open portion to allow the roulette ball to pass through. According to various examples a controller may be configured to independently control a rotation of the rotatable main wheel and the rotatable switch wheel. One or more sensors, including but not limited to optical sensors and proximity sensors, may determine positions of one or more of the main wheel, the switch wheel, and a position of a roulette ball. The one or more sensors may communicate with a revolving mechanism to rotate one or both of the main wheel or the spin wheel, and coordinate receiving one or more roulette balls, or a delivery of one or more roulette balls, e.g., to a launch start position, launch tube, or other output path.

Additional embodiments relate to a roulette machine configured to operate unattended live roulette games in which a roulette ball is launched into an angled annular track encircling a roulette wheel. In some embodiments, a controller associated with the roulette machine regulates one or more inertial values associated with the roulette ball. In some embodiments, a bet close time of a betting window associated with the live roulette games is determined based on one or more inertial values associated with the roulette ball. In some embodiments, a rotation velocity of the roulette wheel is adjusted subsequent to a bet close time of a betting window associated with the live roulette games. In some embodiments, game cycle events are detected using audio associated with the live roulette games. In these embodiments, audio audible and/or visual special effects are generated based on the audio. In some embodiments, a controller associated with the roulette machine synchronizes the live roulette games operated by the roulette machine with live roulette games operated by one or more additional roulette machines.

An embodiment is directed to two or more betting options based on a desired level of risk or volatility, such as low or high or low, medium, or high. Depending on the amount of credits to be bet and the risk level or volatility level chosen, bets will be randomly placed in predetermined amounts on different types of bets that correspond to the risk level. If there are two risk levels, a bet of 50 credits at a low risk level will result in 10 credits being placed on red or black, 10 credits on even or odd, 10 credits on high or low, 10 credits on one third and 10 credits on one column. The same bet at a high risk level will result in 12 credits on a six line, 12 credits on a street, 6 credits on two streets, 5 credits on two splits, and 5 credits on two straight ups, although other betting combinations are possible in other embodiments.

These and other features will be more clearly understood from the following detailed description taken in conjunction with the accompanying drawings and claims. This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION OF EMBODIMENTS

The present disclosure describes particular embodiments and their detailed construction and operation. The embodiments described herein are set forth by way of illustration only and not limitation. Those skilled in the art will recognize, in light of the teachings herein, that there may be a range of equivalents to the exemplary embodiments described herein. Most notably, other embodiments are possible, variations can be made to the embodiments described herein, and there may be equivalents to the components, parts, or steps that make up the described embodiments. For the sake of clarity and conciseness, certain aspects of components or steps of certain embodiments are presented without undue detail where such detail would be apparent to those skilled in the art in light of the teachings herein and/or where such detail would obfuscate an understanding of more pertinent aspects of the embodiments.

Disclosed herein are methods, systems, and computer readable storage media that provide for automated ball exchange operations and magazine designs to improve loading efficiency for roulette wagering systems and other gaming devices. Such improvements may enable greater accuracy and loading speed of roulette balls, thereby increasing the number of games that can be played per given time period. Embodiments further provide specific selection of balls within magazines, which may enable roulette gaming variations and efficient transitions between games. Such features may provide a more efficient gaming experience and improve both guest and dealer satisfaction. Some embodiments of the present invention are described herein in terms of an automated roulette wagering system for illustrative purposes. However, embodiments of the present invention are not limited to roulette wagering system, but rather may be implemented in various gaming and wagering systems—both automated and manual—that provide similar functionalities as a roulette wagering system.

Figure 1:
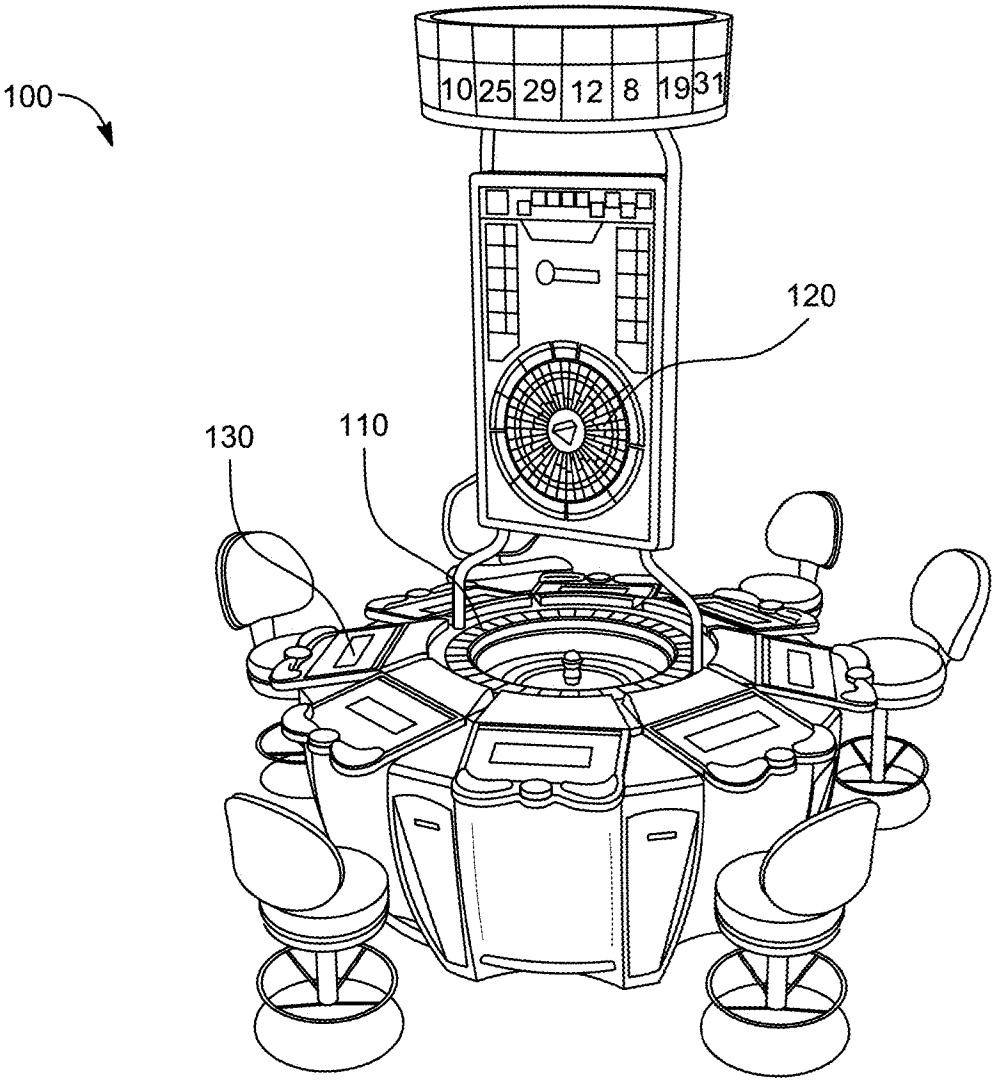
FIG. 1 is a diagrammatic, elevated view of a roulette wagering system in accordance with an embodiment.

FIG. 1 illustrates an automated roulette wagering system 100 in accordance with an embodiment of the present disclosure. As shown by FIG. 1, automated roulette wagering system 100 includes roulette machine 110, central display 120, and a plurality of play stations 130. While six play stations 130 are illustrated in the embodiment depicted by FIG. 1, one skilled in the art will recognize that roulette wagering system 100 may include any number of play stations associated with roulette machine 110.

For example, roulette wagering system 100 may include one play station, two play stations, ten play stations, and so on. In an embodiment, roulette wagering system 100 may not include any play stations 130. For example, roulette wagering system 100 may be servicing one or more remote clients not physically proximate to roulette wagering system 100. That is, roulette machine 110 of roulette wagering system 100 may be an unattended live table game of chance providing game cycle results to one or more play stations physically remote from roulette machine 110. In an embodiment, roulette wagering system 100 may be servicing a combination of local play stations (e.g., play stations 130) and remote play stations.

In an embodiment, roulette wagering system 100 is located at a first geographic location and is providing game cycle results to remote clients physically located at one or more remote geographic locations that are not physically proximate to the first geographic location. For example, roulette wagering system 100 may be located in a warehouse and provide game cycle results to remote clients located in a casino located a few miles away from the warehouse. As another example, roulette wagering system 100 may be located in a first casino and provide game cycle results to remote clients located in a second casino or gaming establishment. The first casino and the second casino or gaming establishment may be located in a different city, state, country, etc.

Roulette Machine

Roulette machine 110 is configured to operate unattended live roulette games in which a physical roulette ball is launched into an angled annular track encircling a roulette wheel. In an embodiment, roulette machine 110 may be configured to operate any known live table game of chance. Each live roulette game operated by roulette machine 110 is composed of a game cycle. The game cycle of the live roulette game begins as a roulette ball is positioned to be launched into the annular track. The roulette ball is launched into the annular track and rotates around the annular track a plurality of times. In an embodiment, the roulette ball is rotated around the annular track in a first direction and the roulette wheel is spinning about a central axis in a second direction opposing the first direction. Friction between the roulette ball and the annular track reduces a momentum of the roulette ball until gravity causes the roulette ball to exit the annular track.

Upon exiting the annular track, the roulette ball follows a path towards the center of the roulette wheel along a downward slope intervening between the annular track and the roulette wheel. As the roulette ball follows the path towards the center of the roulette wheel, the roulette ball may interact with one or more ball stops positioned about the downward slope. When the roulette ball encounters the roulette wheel, the roulette ball bounces a plurality of times and then settles into one of a plurality of ball slots positioned around an outer circumference of the roulette wheel. The game cycle concludes as the roulette ball settles in one of the plurality of ball slots. A game cycle outcome is determined based on a number and possibly also a color corresponding to the particular ball slot in which the roulette ball settled.

Each live roulette game operated by roulette machine 110 is also composed of a betting window associated with the game cycle. The betting window includes a bet open time and a bet close time. The bet open time represents a point in time in which the betting window transitions from a closed state to an open state. After the bet open time, the betting window is in the open state and a player is allowed to place one or more bets or wagers on the associated game cycle. In an embodiment, the player is allowed to place one or more side bets or wagers on at least one additional game of chance when the betting window is in the open state.

The bet close time represents a point in time in which the betting window transitions from an open state to a closed state. After the bet close time, the betting window is in the closed state and the player is no longer allowed to place bets or wagers on the associated game cycle. In an embodiment, the bet close time precedes a time that the roulette ball settles in one of the plurality of ball slots. In an embodiment, the bet close time precedes a time that the roulette ball exits the annular track. In an embodiment, the bet close time is adjustable based on an inertial value associated with the roulette ball.

In operation, roulette machine 110 utilizes one or more random number generators to control various mechanical aspects of the live roulette games. The one or more random number generators are used to increase a randomization of events composing the live roulette games. Increasing the randomization of events composing the live roulette games reduces a likelihood that game cycle results are predictable. For example, random number generators may dictate a velocity that a roulette ball is launched into the angled annular track, a number of times that a roulette ball rotates around the angular track, a direction the roulette ball spins while rotating around the angular track, a timing of various events composing the live roulette games, and the like.

Central display 120 is configured to present players and other guests of the casino or other gaming establishment with information associated with the live roulette games operated by roulette machine 110. Such information may be presented in a visual format, an auditory format, or a combination thereof. The information presented by central display 120 may include information regarding individual results of previous game cycles, a state of a current betting window associated with roulette machine 110, statistics about previous games cycles, an operating condition of roulette machine 110, a progressive jackpot associated with roulette machine 110, and the like. In an embodiment, central display 120 is further configured to present players and other guests of the casino or other gaming establishment with advertising media.

Each play station among the plurality of play stations 130 is generally configured to enable a player to participate in the live roulette games operated by roulette machine 110. In an embodiment, each play station among the plurality of play stations 130 is further configured to enable the player to participate in at least one additional game of chance. In an embodiment, the at least one game of chance is operated by a gaming device other than roulette machine 110. For example, a play station 130 may enable the player to fund a credit balance for placing bets, place bets on games of chance (e.g., the live roulette game operated by roulette machine 110), receive winnings associated with bets placed on games of chance, and the like. In an embodiment, a play station may enable the player to interact with an object associated with a game of chance. Examples of such objects include dice, a ball, a wheel, and the like.

Figure 2:
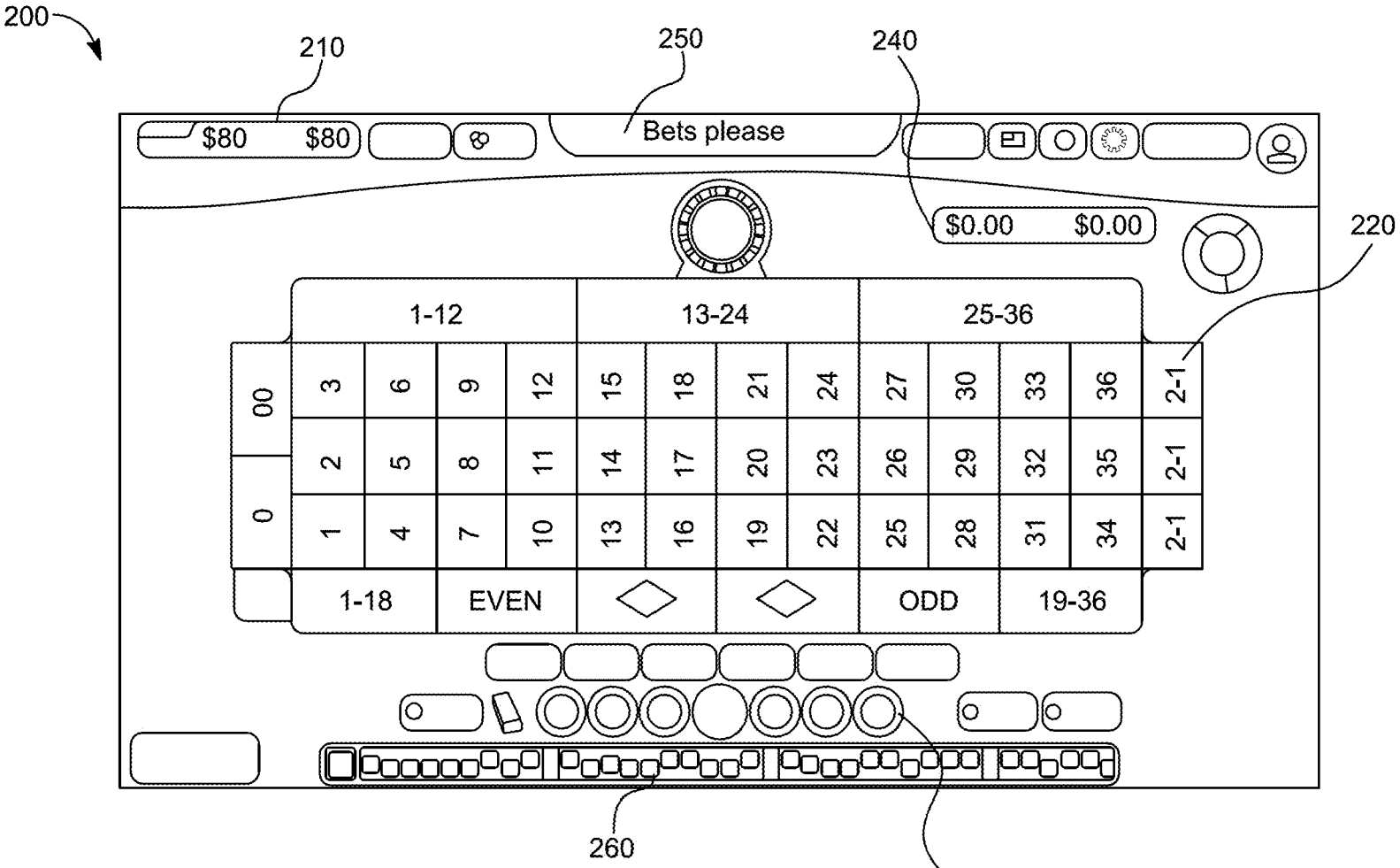
FIG. 2 illustrates an example graphical user interface ("GUI") displayed by a play station, in accordance with an embodiment.

As best seen in FIG. 2, play station 130 may present a graphical user interface ("GUI") 200 that enables a player to participate in the live roulette games operated by roulette machine 110. For example, GUI 200 may display account information 210 to a player that represents a maximum credit balance that is available to the player for wagering on the live roulette games. In an embodiment, a player may insert currency, tickets, tokens, and the like into play station 130 in order to increase the maximum credit balance. In an embodiment, a player may electronically transfer funds from another account using play station 130 in order to increase the maximum credit balance.

GUI 200 may also display an electronic representation of a felt betting area 220 (or layout) for live roulette games operated by roulette machine 110. The player may wager on the live roulette games by placing one or more virtual chips 230 onto the felt betting area 220. For example, the player may place virtual chips 230 onto an area of felt betting area 220 that identifies a particular ball slot in which the player believes a roulette ball will come to rest within a particular game cycle. As another example, the player may place virtual chips 230 onto an area of felt betting area 220 that identifies a particular range of ball slots in which the player believes a roulette ball will come to rest. The player may also place virtual chips 230 onto felt betting area 220 to bet that during a particular game cycle a roulette ball will come to rest in a ball slot associated with a particular color (e.g., red or black). As another example, the player may also place virtual chips 230 onto felt betting area 220 to bet that a roulette ball will come to rest in a ball slot associated with an odd or even number.

A wagering update area 240 of GUI 200 may also present information regarding an amount currently wagered by the player on the live roulette games operated by roulette machine 110. Information regarding a payout amount won by the player through previous bets may also be presented to the player in wagering update area 240. In an embodiment, wagering update area 240 may also present the player with information regarding an aggregate amount wagered and/or won in a current session. In an embodiment, wagering update area 240 may also present the player with information regarding an aggregate amount wagered and/or won within a predetermined period of time (e.g., hour, day, month, year, lifetime, etc.).

GUI 200 may also present a status update area 250 that provides the player with information about a current game cycle of the live roulette games operated by roulette machine 110. For example, status update area 250 may inform the player that a betting window associated with the current game cycle is in an open state. The betting window is in the open state between a bet open time and a bet close time. As long as the betting window remains in the open state, the player is free to wager on the current game cycle of the live roulette games. The betting window associated with the current game cycle transitions from the open state to a closed state when the bet close time is reached. Status update area 250 may inform the player that a betting window associated with the current game cycle is in the closed state.

A historical data area 260 of GUI 200 may provide the player with information about results from previous game cycles of the live roulette games. For example, historical data area 260 may display a sequence of individual results from the previous game cycles. As another example, historical data area 260 may display statistical information about the previous game cycles. The statistical information may include a percentage of a predetermined number of previous game cycles in which the roulette ball came to rest in a particular color, a ball slot associated with an odd number, a particular range of ball slots, and the like.

Figure 3:
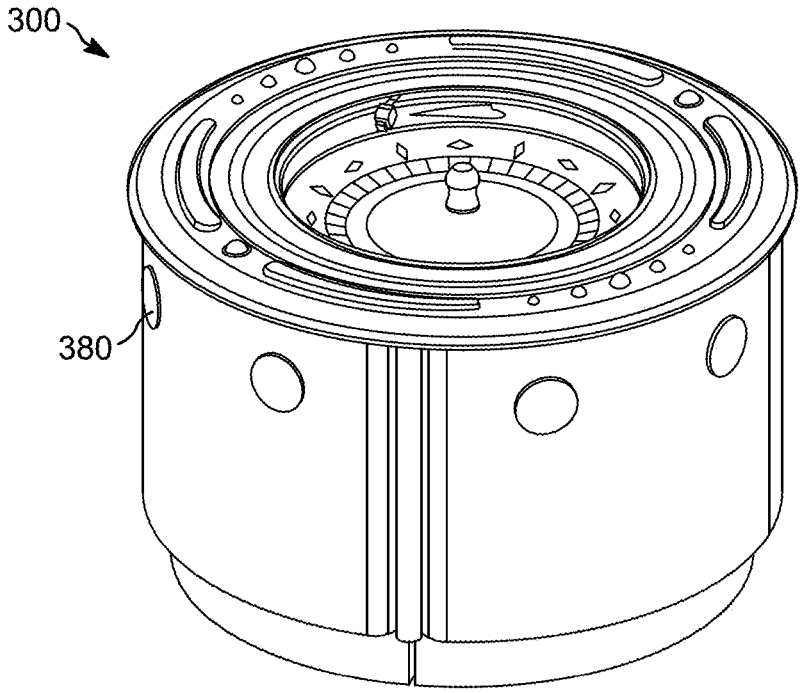
FIG. 3 is a diagrammatic, elevated view of a roulette machine in accordance with an embodiment.
Figure 4:
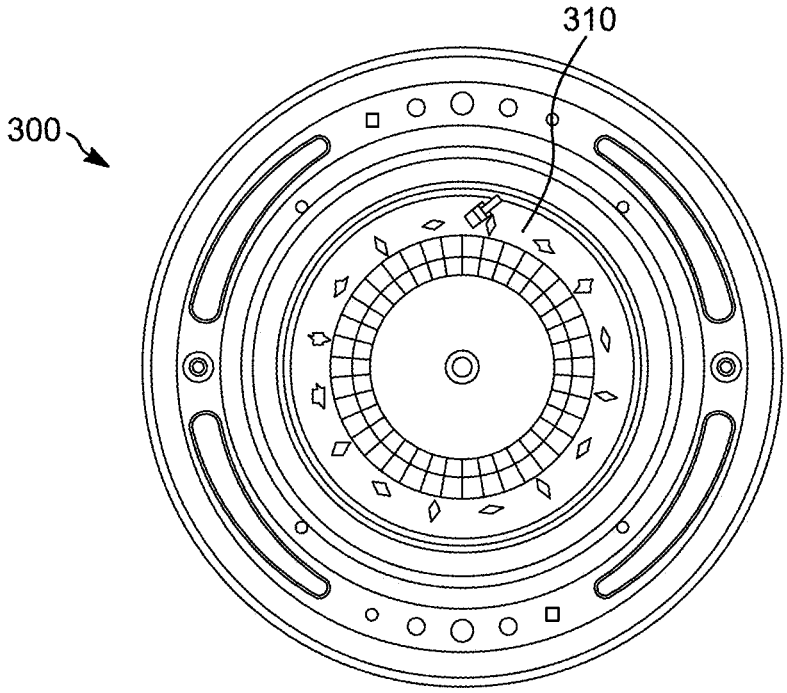
FIG. 4 is a top down view of the roulette machine depicted by FIG. 3, in accordance with an embodiment.
Figure 5:
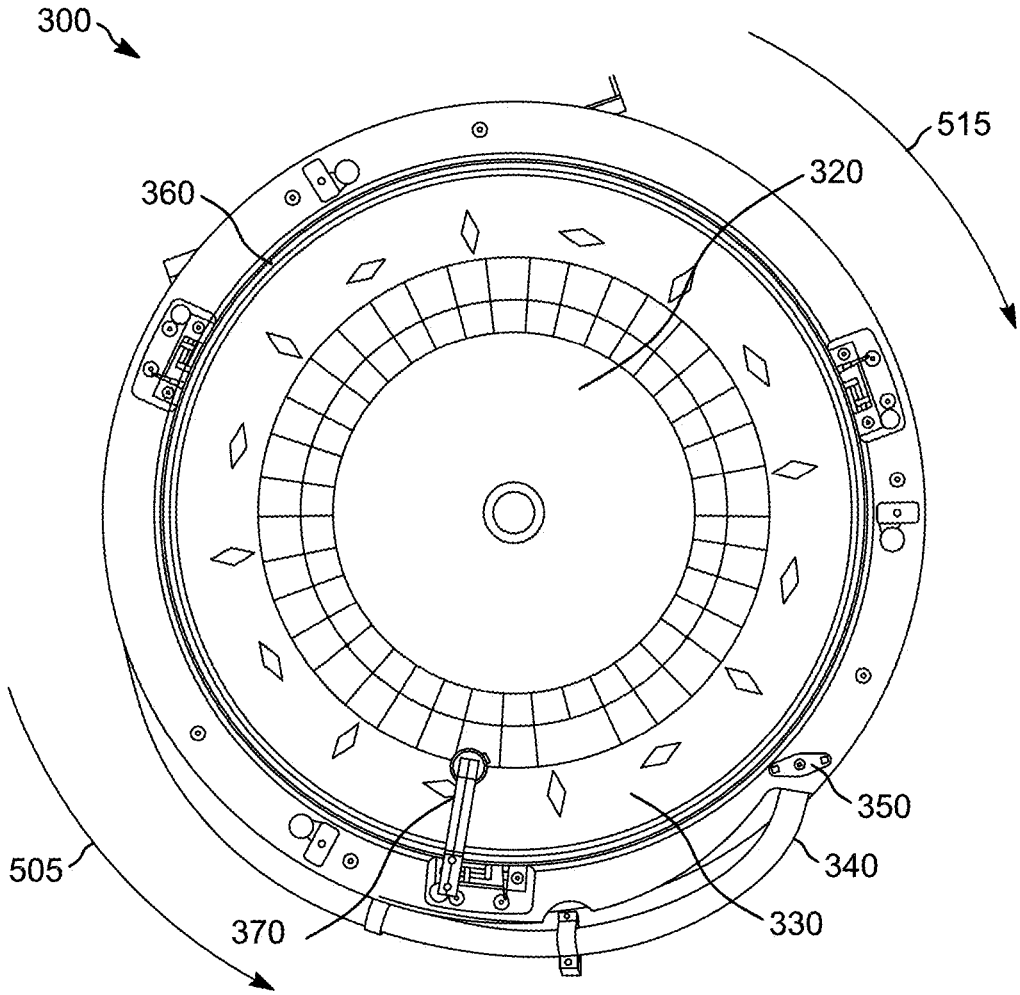
FIG. 5 is a view similar to FIG. 3, but with a transparent cover removed, in accordance with an embodiment.

FIGS. 3-5 illustrate a roulette machine 300 in accordance with an embodiment of the present disclosure. In an embodiment, roulette machine 300 may be used to implement roulette machine 110 of roulette wagering system 100 in FIG. 1. As best seen in FIG. 4, a transparent cover 310 (e.g., a glass dome) encases an underlying roulette wheel 320 such that aspects related game play remain visible. Transparent cover 310 may provide a physical means of isolating roulette wheel 320 from an environment surrounding roulette machine 300. By isolating roulette wheel 320, transparent cover 310 reduces the likelihood that game cycle results are impacted by influences present in the environment surrounding roulette machine 300. Examples of such influences include dealers, players, external dust, air flow, and the like.

Turning to FIG. 5, atop down view of roulette machine 300 is provided after transparent cover 310 has been removed. As shown by FIG. 5, roulette machine 300 includes roulette wheel 320, annular track 330, and ball launch tube 340. In operation, a roulette ball is launched from ball launch tube 340 into annular track 330 at launch point 350 as each game cycle commences. In the example depicted by FIG. 5, the roulette ball is launched in a direction represented by the arrow associated with designator 505. As the roulette ball rotates around roulette wheel 320, roulette wheel 320 is rotating in an opposing direction represented by the arrow associated with designator 515.

In an embodiment, roulette machine 300 further includes at least one inertial data sensor 360 associated with annular track 330, such as being incorporated into the annular track 330 in some manner. Inertial data sensor 360 is configured to obtain inertial information associated with a roulette ball launched into annular track 330. Examples of such inertial information include a velocity that the roulette ball is launched into annular track 330, deceleration of the roulette ball's velocity after being launched into annular track 330, and the like. The inertial information obtained by inertial data sensor 360 may be used to determine inertial-related information associated with the roulette ball subsequent to being launched into annular track 330, and the like. Such inertial-related information may include a number of time that the roulette ball rotates within angular track ("ball revolutions"), a direction the roulette ball spins while rotating around angular track 330, a velocity that the roulette ball spins while rotating around angular track 330, and the like.

In an embodiment, roulette machine 300 further includes at least one image sensor 370. The at least one image sensor 370 is configured to capture image data associated with particular game cycles of the live roulette games operated by roulette machine 300. Image sensor 370 may provide the captured image data to a controller associated with roulette machine 300 as a video stream, a sequence of individual image frames, raw image data, and the like. In an embodiment, a controller (in the form of a computer system, see FIG. 18) associated with roulette machine 300 may configure image sensor 370 by specifying a frame-rate, a resolution, a color value, a video stream encoding format, a subset of the image sensor's available pixels to activate and/or deactivate, and the like.

In an embodiment, image sensor 370 is configured to capture image data on a continuous basis. For example, the image data captured by image sensor 370 may provide a live video feed of the live roulette games operated by roulette machine 300. In an embodiment, image sensor 370 is configured to capture image data for a predefined period of a particular game cycle. For example, such predefined periods may be associated with a roulette ball being launched into annular track 330, a roulette ball coming to rest in a particular ball slot of roulette wheel 320, a betting window associated with a particular game cycle, and the like.

In an embodiment, image sensor 370 is configured to capture image data associated with a particular area of roulette wheel 320. Examples of the particular area include launch point 350, an arc portion of annular track 330, a predefined reference point of roulette wheel 320, a table stop position of roulette wheel 320, and the like.

In an embodiment, roulette machine 300 further includes one or more audio output devices 380 (e.g., speakers). As best seen in FIG. 3, the audio output devices 380 may positioned around an outer circumference of roulette machine 300. The audio output devices 380 may present audible announcements regarding events associated with roulette machine 300. The audible announcements may enable roulette machine 300 to better serve hearing impaired guests. Examples of such events include information about an operating state (e.g., down for maintenance) of roulette machine 300, information about a current game cycle (e.g., a betting window associated with the current game cycle is open), and the like. The audio output devices 380 may also provide background music, sound effects, and the like to players and other guests interacting with roulette machine 300.

Because the roulette wheel 320 is covered by transparent cover 310, it may not be possible for players to hear the ball as it spins and jumps around on the roulette wheel 320, which for some players changes a favored aspect of the game. Hence, the audio output devices 380 may play sounds that correspond to the movement of the ball as it launched, as it moves around the annular track 330, as it bounces around on the roulette wheel 320, and as it settles into a ball slot. Lighting may also be employed to help players follow the movement of the ball.

Figure 6:
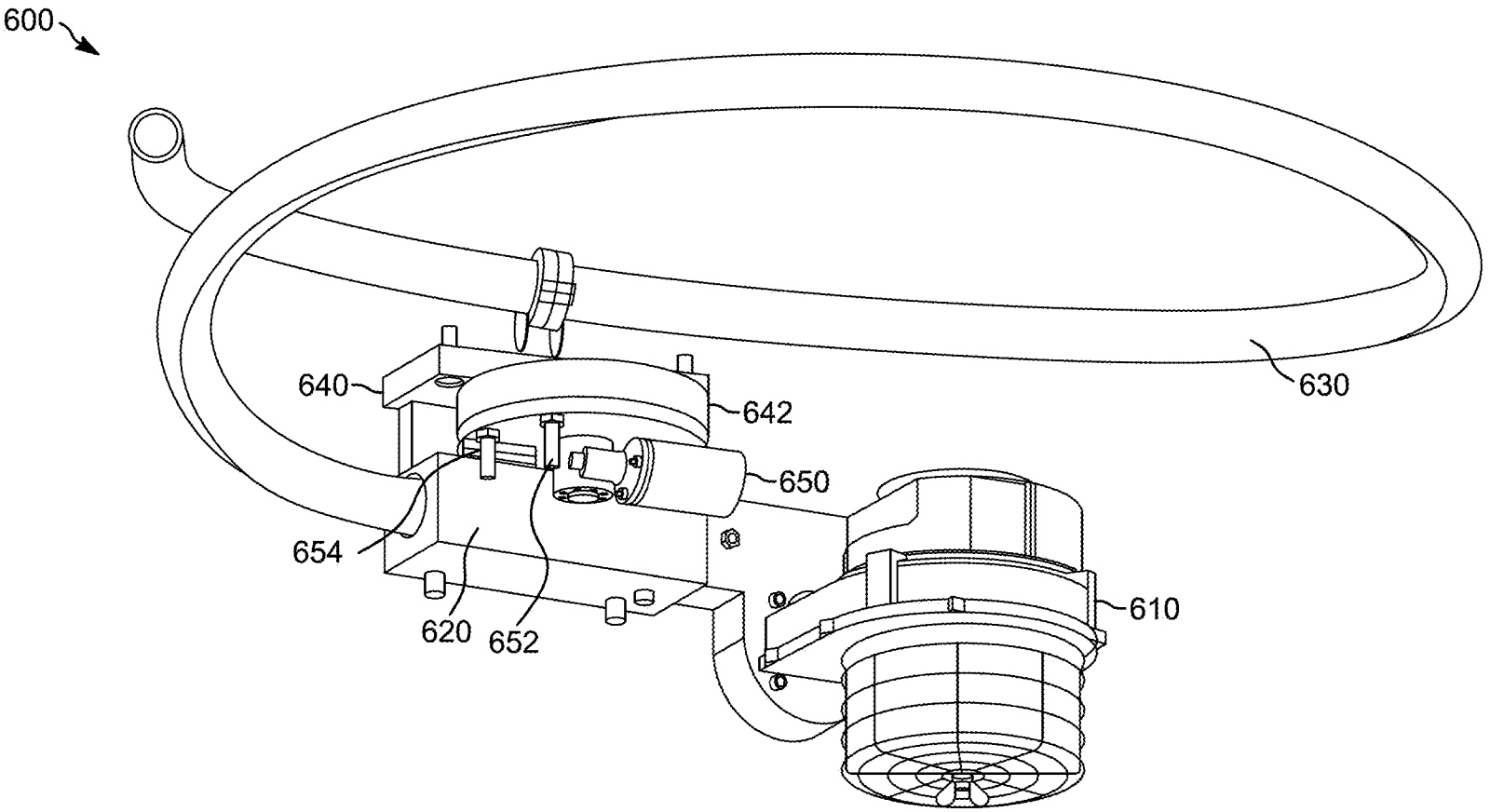
FIG. 6 is a diagrammatic, lateral view of a ball launcher assembly, illustrating a front side of a ball-change magazine, in accordance with an embodiment.

FIG. 6 illustrates a ball launch assembly 600 in accordance with an embodiment of the present disclosure. As shown by FIG. 6, ball launch assembly 600 includes a propulsion assembly 610, launch device 620, and ball launch tube 630. In an embodiment, ball launch tube 630 is used to implement ball launch tube 340 of FIG. 5. Ball launch assembly 600 is configured to launch a roulette ball into the annular track at a launch point of a roulette machine (e.g., roulette machine 300 of FIGS. 3-5) coupled to ball launch assembly 600. In operation, ball launch assembly 600 receives launch commands from a controller associated with the roulette machine. Each launch command initiates a game cycle of the live roulette games operated by the roulette machine.

In response to receiving a launch command, ball launch assembly 600 introduces a roulette ball into the launch device 620, where propulsion from the propulsion assembly 610 launches the roulette ball through the ball launch tube 630. Launch device 620 imparts a motion to the ball thereby launching the roulette ball into the annular track of the roulette machine. Various means may be used by launch device 620 to impart motion to the roulette ball, such as spring-based propulsion, electromagnetic propulsion, vacuum propulsion, pressurized air propulsion, and the like. For example, launch device 620 may be implemented using a vacuum generator, a regulated air fan for blowing the ball out of the launch tube, a spring-actuated ball collider, a variable magnet, and the like.

Roulette Ball Selection and Replacement

After a prolonged period of operation of a roulette machine, the roulette balls will begin to wear, which can negatively impact the controllability of the roulette machine. Accordingly, the roulette balls need to periodically be replaced. Traditionally, this required that the roulette machine be shut down so the ball launch device 620, typically positioned under the roulette wheel 320, can be accessed. If the roulette machine is going to be shut down, then it might as well be cleaned too, so this often results in the roulette machines being out of operation, and therefore not generating revenue, for a longer period of time, which casino operators did not appreciate. However, just because the roulette balls need to be replaced does not mean that the entire machine really needs cleaning as well, so if roulette balls could be replaced more readily without requiring the roulette machine to be taken out of service, that would be preferable.

Figure 7:
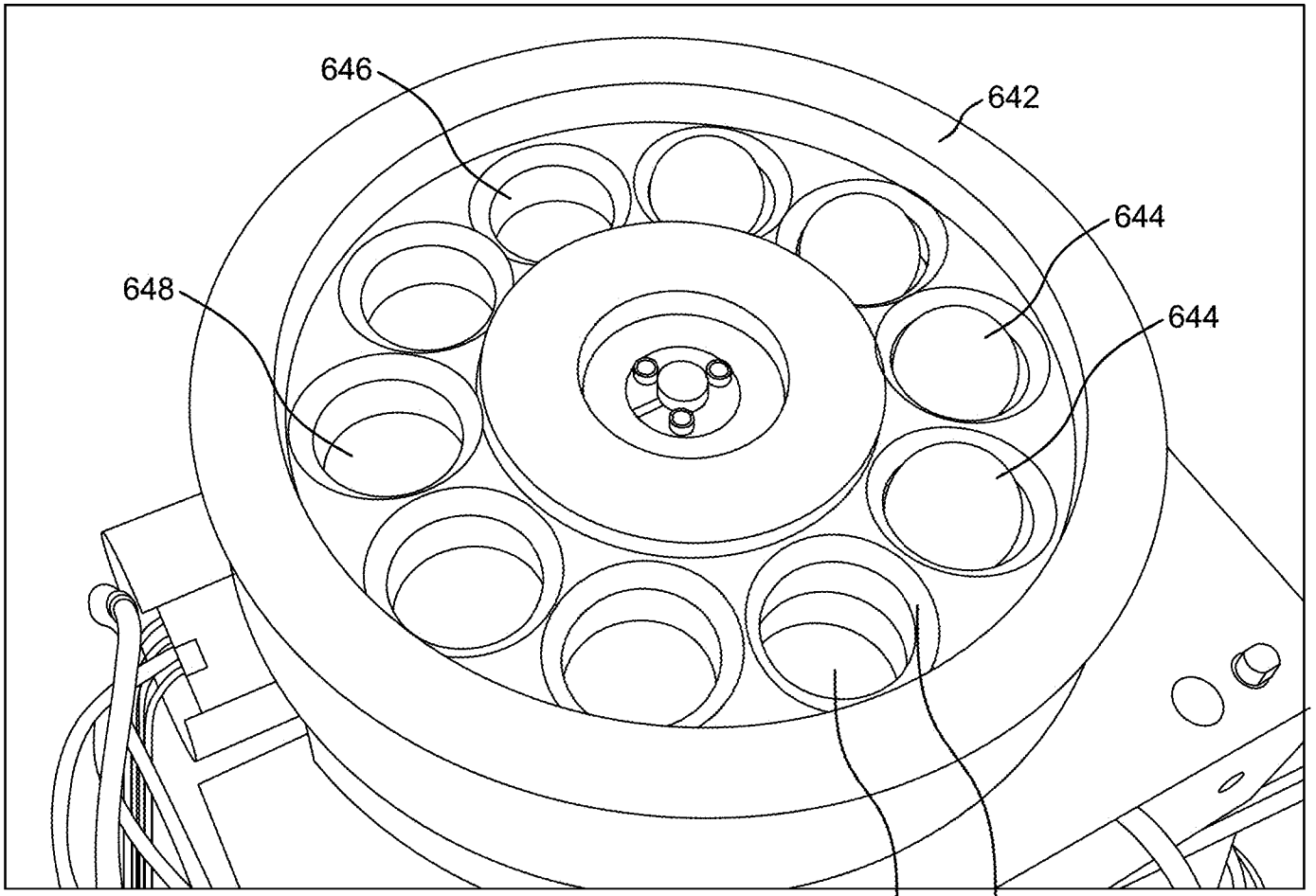
FIG. 7 is a diagrammatic, elevated view of a revolving mechanism holding roulette balls of the ball-change mechanism, in accordance with an embodiment.

In an embodiment, an automatic ball-change mechanism may include a main wheel 910 and a switch wheel 920 to provide selective ball-change operations. In various embodiments, the main wheel may be a magazine 640, which may be added to the launch device 620 so as to further extend the operational period of a roulette machine between maintenance and cleanings. The switch wheel 920 may also be added to the launch device 620, and positioned between the magazine 640 and a launch starting point. As shown in FIG. 7, the magazine 640 may include a revolving mechanism 642 that includes up to ten roulette balls 644, each of which corresponds to a pocket 646 in the revolving mechanism 642. The magazine 640 may have 10 pockets for ten roulette balls 644. During a game cycle, however, one roulette ball would be in use (the "current game ball") with the other nine roulette balls being stored for future use (the "stored balls"). When it is determined that the current game ball needs to replaced, the revolving mechanism 642 of the magazine 640 may rotate by one pocket and the next stored ball would become the current game ball. In other examples, when the switch wheel 920 is in the closed position, thereby preventing a ball from dropping into the launch starting point, the magazine 640 may rotate to a specific pocket so that its stored ball would become the next current game ball. The controller of the roulette machine 300 may determine when the current game ball would need to be replaced, which may be a predetermined number of game cycles. That predetermined number could be set by a maintenance operator. When all ten balls in the magazine 640 have been used (or even when nine balls have been used and the tenth is in use), a maintenance alert may be sent indicating that the roulette balls need to be replaced with ten new roulette balls.

Figure 8:
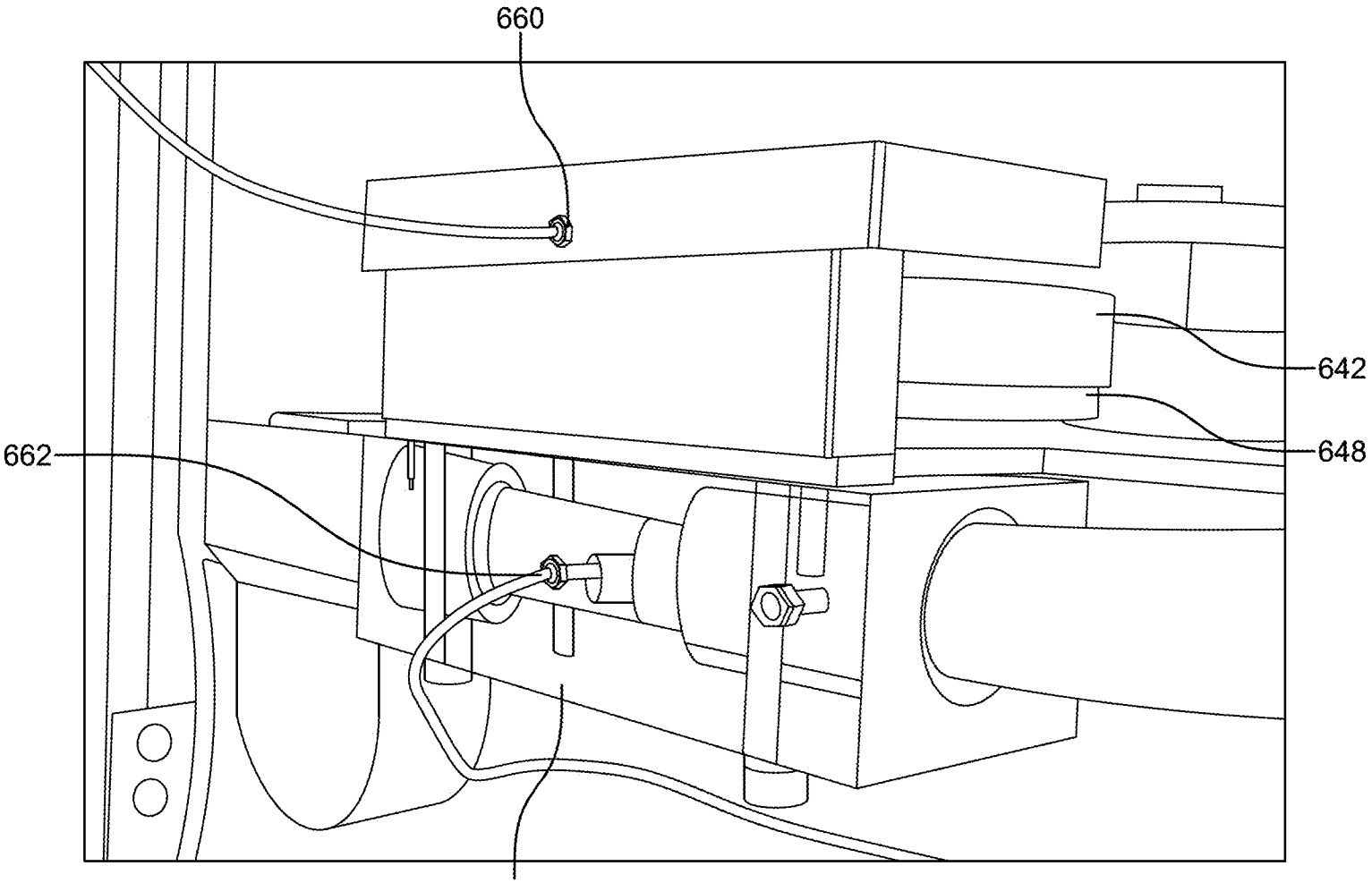
FIG. 8 is a diagrammatic, elevated view of a back side of the ball-change mechanism of FIG. 6, in accordance with an embodiment.

The magazine 640 may further include a base plate 648 over which the revolving mechanism 642 rotates, a ball change motor 650, two sensors and two inductive proximity sensors. The inductive sensors, which may serve to detect the position of the revolving mechanism 642, are best illustrated in FIG. 6, which illustrates a front side of the magazine 640. Sensor 652 may be configured to detect when the ball-change magazine is in a closed position, while sensor 654 may be configured to detect when the ball-change magazine is in an open position, as further explained below. The sensors, which detect the position of a roulette ball, are best illustrated by FIG. 8, which illustrates a back side of the magazine 640. Sensor 660 may be configured to detect when a roulette ball is in the magazine 640, while sensor 662 may be configured to detect when the current game ball is in the start position within the ball hold-and-start mechanism 664 (also referred to herein as the launch start position 914).

One or both of sensors 660, 662 may be optic sensors and include a color sensor to detect different colors of roulette balls. The color sensor may identify a ball color based on an intensity of light. In some examples, the color sensor may include at least one photoelectric sensor such as an LED, laser, or other light emitter to emit light onto a roulette ball, and determine a color based on the reflected light. In other examples, the color sensor may use a photodetector to identify a ball color based on a wavelength and/or intensity of detected light, without necessarily emitting light onto the roulette ball.

In an embodiment, different colored roulette balls may be formed of different materials or have different coatings that identify the color of each ball. Roulette balls may be formed of materials having different metal, chemical, magnetic or electrical properties, or other properties, that can be sensed by sensors 660, 662, which may be metal sensors, chemical sensors, magnetic sensors, electrical sensors and the like.

Since sensors 660, 662 may be configured to detect, respectively, when the current game ball is in the magazine 640 or the ball hold-and-start mechanism 664, the color sensor may provide information about a roulette ball's color at a time when a ball is in each of those positions. When the current game ball is in the magazine 640, for example, the color identification may affect where and when the ball should be delivered. In an example, a color identification of a white ball may indicate a standard roulette ball and that delivery to the launch start position should proceed as normal. A colored ball may indicate a special ball, which may be launched every 2, 5, 10, or N games, or randomly, so its delivery to the launch start position may be delayed, with the ball held within the magazine until the desired timing. In other examples, a roulette ball's color may determine whether the roulette ball gets delivered to a first output path or second output path, such as the launch start position, another launch tube, a collection area, or other path.

Color information may also be usable for gameplay variations. For example, a bonus or multiplier may be initiated when a certain color game ball is launched into play. Position information, such as the presence of a ball in the ball hold-and-start mechanism 664, may assist in timing and execution of color-based games. Other entertainment features, e.g., lights, effects, sounds, and other actions to keep player attention and interest, etc., may be initiated based on the game ball color.

The color sensors may further enable a certain, desired roulette ball to be selected for a particular game or round of a game. The color sensors may also provide color information in advance of gameplay being initiated. For example, the color sensor may identify roulette ball colors as they arrive within the magazine 640. The color of roulette balls within the magazine may be identified, and usable for positioning, tracking, and other gameplay operations. A particular roulette ball may also be selected from the magazine 640, based on its identified color. The rotatable main wheel, base plate, and rotatable switch wheel, for example, may coordinate movements to ensure that the particular roulette ball is delivered to the proper position, e.g., the launch start position 914, at a desired time.

Figure 9:
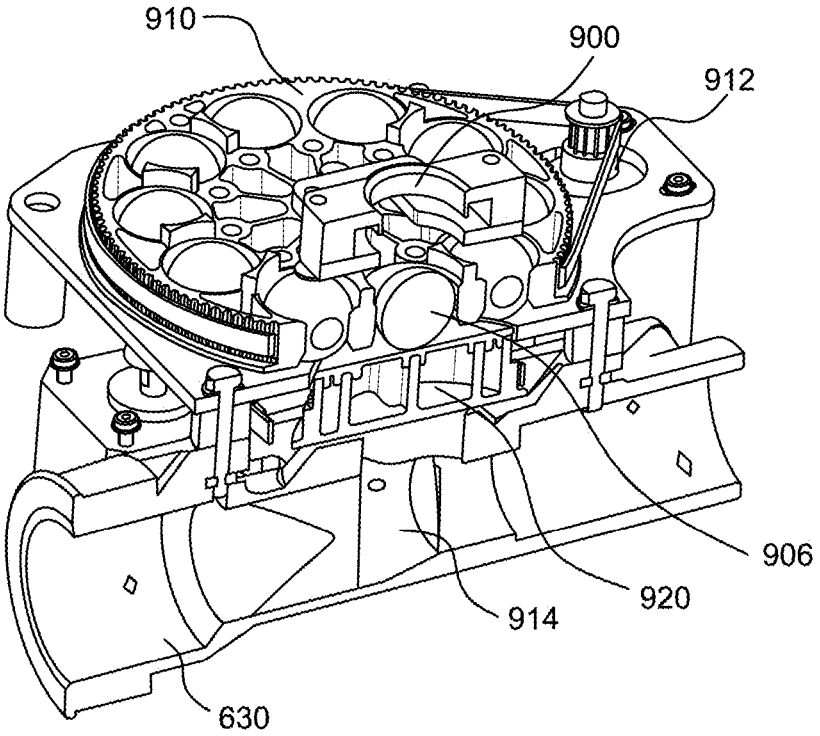
FIG. 9 illustrates an example cross-section of the ball-change magazine in a closed position, in accordance with an embodiment.

FIG. 9, FIG. 10, FIG. 11, and FIG. 12 illustrate ball change operations and magazines of the roulette machine 300 during normal roulette game cycles. As shown in FIG. 7, the base plate 648 may be fixed and the revolving mechanism 642 may rotate about it. The base plate may include a through hole 655 through which the current game ball may pass when a pocket 646 is aligned with the hole 655. As shown in FIG. 9, when a game cycle of the roulette machine has finished, the ball slot of the roulette wheel (not shown) holding the current game ball may be positioned over a chute 900. In some embodiments, the chute 900 may include a trap door mechanism 901, having a barrier preventing the ball from falling, via gravity, towards the main wheel 910. The trap door 901 mechanism may include one or more slidable parts to create the barrier. The chute and trap door may allow a game ball to directly drop into a pocket (e.g., pocket 646) of the main wheel 910. In some gaming systems, a tube of balls may be positioned above the chute 900 ready to deliver a ball, when needed, into an empty pocket of main wheel 910. The trap door 901 may communicate with one or more sensors to open and deliver a ball at a desired time. The trap door 901 may also serve to prevent more than one ball from being delivered at a time, and to control the delivery, speed, and timing, of a ball drop to the main wheel 910 below. In some embodiments, the chute 900 and/or trap door 901 may be physically mounted to each other, the main wheel, and/or another part of the roulette machine 300 to ensure proper stability and alignment.

Figure 10:
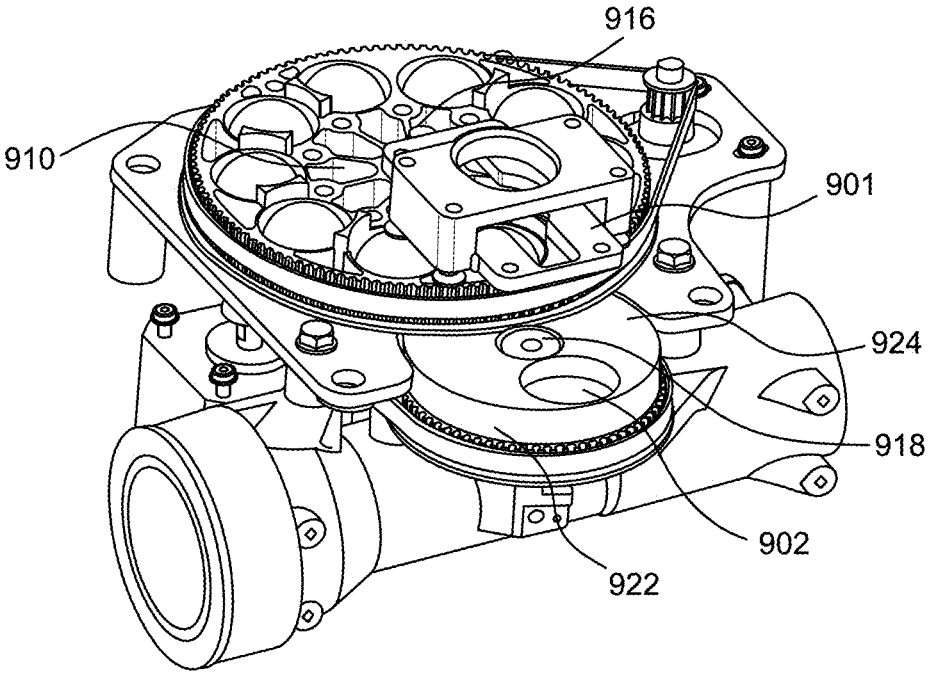
FIG. 10 illustrates an example of the ball-change magazine in a closed position, in accordance with an embodiment.

FIGS. 9 and 10 illustrate ball-change operations when the ball-change magazine is in the closed position. A main wheel 910 may be positioned above a switch wheel 920. The main wheel 910 may be similar to the wheel illustrated in FIG. 7 and comprise a plurality of pockets (e.g., ten pockets) to hold a game ball 906. The switch wheel 920, positioned beneath the main wheel, includes a hole 902 through which a ball passing through a pocket of the main wheel 910 may fall through, via gravity, to a launch start position 914 when a main wheel pocket and switch wheel hole 902 align. The switch wheel 920 is positioned between the main wheel 910 and the launch tube 630. In some embodiments, the switch wheel 920 may be secured to a base plate or base platform upon which the main wheel is placed. In some examples, the switch wheel may be attached to one or both of the main wheel 910 and the launch tube 630. In other embodiments, one or more posts 926 may secure a position of any or all of the main wheel 910, switch wheel 920, or launch tube 630.

The main wheel 910 may be rotated about a central axis 916 by a revolving mechanism. The revolving mechanism may include a belt 912 placed around a circumference of the main wheel. In some embodiments, the belt 912 may run along a defined groove in along the circumference of the wheel. In various embodiments, the belt frictionally grips the circumference of the main wheel 910 such that driving the belt, e.g., via revolving mechanism 642, causes the rotation of the main wheel 912 in a first direction. The switch wheel 920 may be similarly driven by a belt positioned around a circumference of the switch wheel. One or more sensors, such as those associated with the revolving mechanism may operate one or both belts.

The rotation of the main wheel 910 and the switch wheel may be coordinated to allow selection of a particular ball within a pocket of the main wheel to drop below to the launch start position 914. This may be useful for roulette gaming variations, such as golden ball, as discussed herein. FIGS. 9 and 10 show the ball-change magazine in the closed position. The pocket holding ball 906 above the launch tube is aligned with a hole (e.g., hole 655), however the top plate 924 of the switch wheel blocks the ball from falling below to the launch tube.

The closed position allows a specific ball within the main wheel 910 to be selected, since the main wheel 910 may be rotated until the pocket holding the desired ball is in the proper drop position above the switch wheel 920 and launch tube. This provides significant advantages over traditional magazines, in which the ball would drop in sequence. In such embodiments, ball placement order in the main wheel must be deliberate and would not allow for reordering or variation once placed in the pocket. In the present embodiments, the switch wheel 920 may be rotated such that the top plate 924 blocks the path to the launch start position 914.

Figure 11:
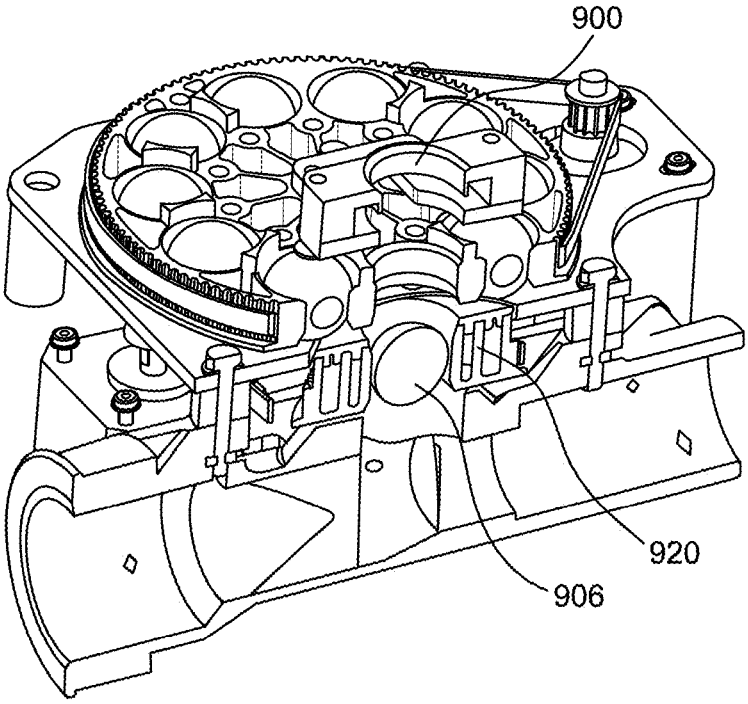
FIG. 11 illustrates an example operation of the ball-change magazine in the open position, in accordance with an embodiment.
Figure 12:
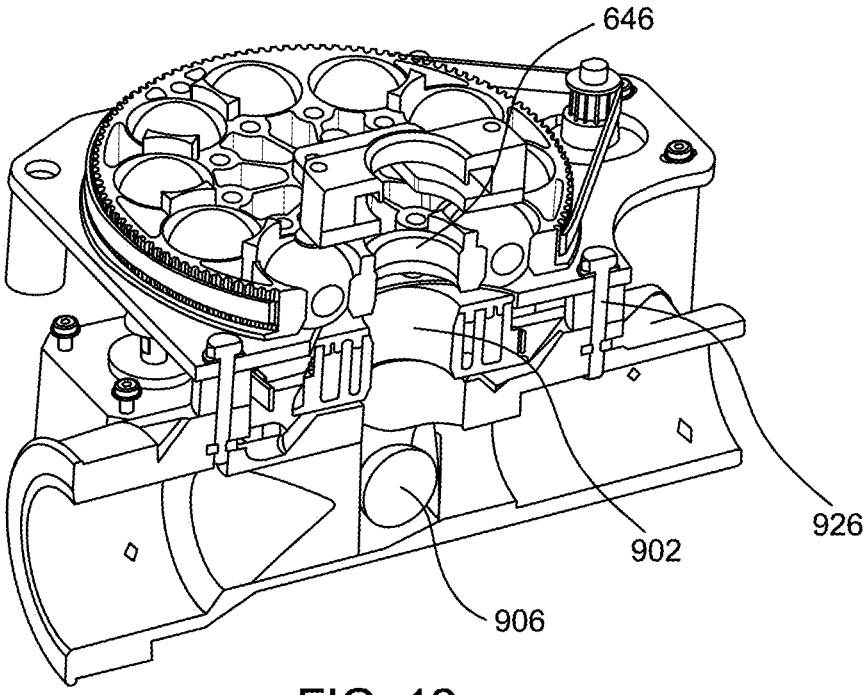
FIG. 12 illustrates an example operation of the ball-change magazine in an open position with a next ball in the launch position, in accordance with an embodiment.

To change to the open position, as seen in FIGS. 11-12, the main wheel 910 may be rotated so the selected ball (e.g., ball 906) is positioned above the path to the launch start position 914. When the main wheel 910 aligns the pocket with the selected ball, the switch wheel 920 may rotate to allow the ball 906 to drop from the pocket, through the switch wheel hole 902 to the launch start position 914.

Additional advantages include the ability to control timing of when the ball drops into the launch start position 914. As discussed herein, one or more sensors may regulate the revolving mechanisms of the main wheel and switch wheel belts to control when the ball change magazine switches between the closed position and the open position.

Various embodiments further allow loading of many roulette balls at the same time without causing jamming or unintended ball drops into the launch start position 914. Multiple balls may drop into chute 900, and when the switch wheel is in the closed position (i.e., top plate 924 blocks the path to the launch start position 914), the main wheel 910 may rotate to allow balls in the chute to drop into respective empty pockets. Since the switch wheel hole 902 is not aligned with the main wheel hole 655, balls are prevented from dropping into the launch start position 914, and ball jams, which would traditionally occur without the switch wheel 920, are likewise prevented.

To remove the current game ball from the roulette wheel 320 (not shown), the trap door mechanism 901 may be opened, causing the ball to fall, via gravity, through an opening under the trap door mechanism 901. When the main wheel 910 and switch wheel 920 are in the open position (see, e.g., FIGS. 11-12), there may be an open path through the pocket 646 and the through hole 655 into the ball hold-and-start mechanism 664, where the current game ball 906 waits until launched again.

Once the current game ball has been used a predetermined number of times, for example as many as 10,000 times, the current game ball may be changed to a next roulette ball. The process by which this is may be possible is illustrated in FIG. 10. During the game cycle and just before the trap door 901 is opened, the revolving mechanism 642 may be rotated in a forward direction to the closed position. The revolving mechanism 642 may stop rotating when sensor 654 indicates the revolving mechanism 642 is in the closed position. The closed position is a position that may be sufficient to block passage of the current game ball 906 from falling into the hold-and-start mechanism 664 but may be wide enough to allow the current game ball 906 to fall through the opening 902 into the pocket 646, as further shown in FIG. 11. Once the current game ball 906 has been trapped in the pocket 646, the revolving mechanism 642 may be rotated forwarded again to the open position, as detected by sensor 652, as shown in FIG. 12, which may cause the next game ball 908 to drop into the hold-and-start mechanism 664, where it waits until launched for the first time. The magazine 640, or more accurately the revolving mechanism 642, may then stay in the open position for the predetermined number of times, before the next roulette ball change is initiated.

Figure 13:
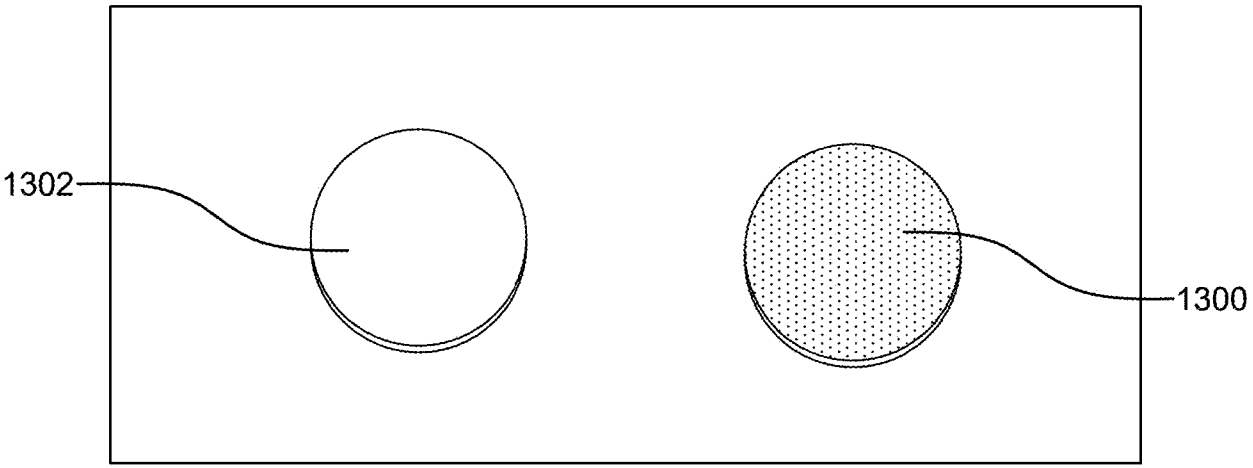
FIG. 13 illustrates a regular white roulette ball and a special golden roulette ball, in accordance with an embodiment.

In an embodiment, the magazine may also be used to introduce a further random event, the launching of a special roulette ball, referred to herein as a "golden ball." As illustrated in FIG. 13, the golden ball 1300 may be formed of a phenolic resin that gives the roulette ball a golden color, although other suitable materials generating the same or other colors may also be used. The phenolic resin may be magnetic or not magnetic. The golden ball may have a different appearance than the regular roulette balls 1302, which tend to be a white or off-white color. In the embodiment, five golden balls may be used in place of five white balls. The white balls are place in odd pocket positions of the revolving mechanism, such as pockets 1, 3, 5, 7 and 9, and the golden balls are place in even pocket positions, such as pockets 2, 4, 6, 8 and 10, such that roulette balls are alternated through the revolving mechanism's pockets.

In operation, the white ball 1302 would be used for some period of time until a random number generator determines that a golden ball 1300 should be used in place of the white ball 1302. When a golden ball 1300 is to be used, the revolving mechanism may be rotated to trap the current game ball, but the revolving mechanism would not rotate forward again once the current game ball is trapped, but rather reverse so that a golden ball 1300 is release instead of the white ball. The golden ball may then be used for one game cycle, trapped when the game cycle is over and replaced with the white ball.

When golden balls are used, a couple of additional inductive proximity sensors may also be used. One or more sensors may be used in the same manner as sensors 652 and 654 to keep track of when the revolving mechanism is in the even position. In an embodiment, a sensor may sense when a golden ball is being used and provides an alert to the roulette machine 300 so different game play for the golden ball can be initiated. Any or all sensors may be extra sensitive to either magnetic material used in the golden ball or capable of detecting metal races added to the golden ball coating.

Figure 14:
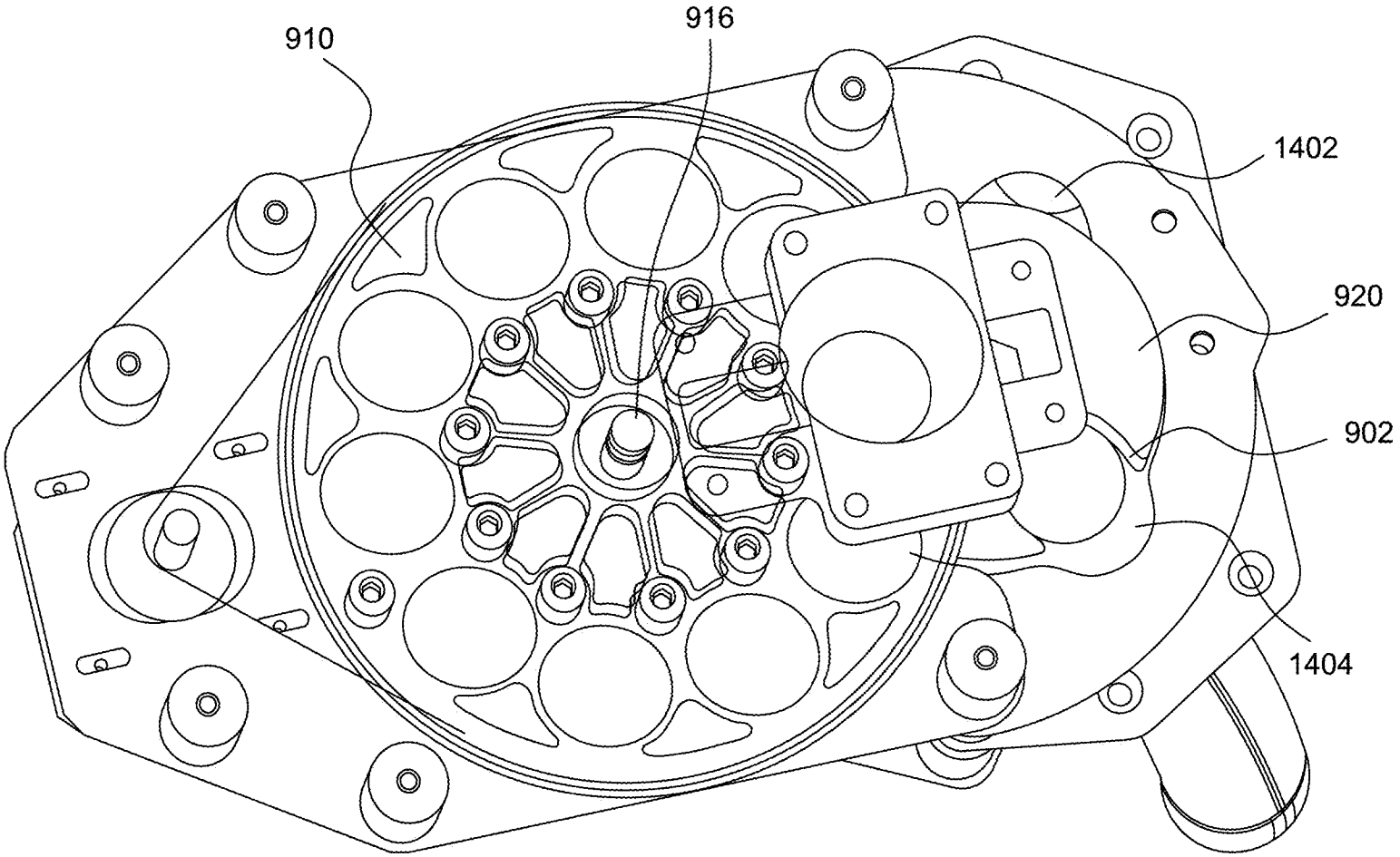
FIG. 14 illustrates an example operation of the ball-change magazine for multiple launching outputs, in accordance with an embodiment.

FIG. 14 illustrates ball-change magazine with multiple launching outputs. Similar to the ball-change magazines discussed in FIGS. 9-12, a main wheel 910 and a switch wheel 920 may be coordinated to drop a ball located in a pocket of the main wheel 910 to a launch tube below. FIG. 14 illustrates two possible outputs for a ball dropping through main wheel 910 and switch wheel 920: left launching output 1402 and right launching output 1404. The illustrated switch wheel 920 is positioned such that the switch wheel hole 902 is aligned with the right launching output 1404. The switch wheel may be rotate to block, via top plate 924, the path of a ball in the main wheel, align the switch wheel hole 902 with the left launching output 1402 to create a path for the selected ball to drop into the launching output 1402, or align the switch wheel hole 902 with the right launching output 1404 to create a path for the selected ball to drop into launching output 1404. In some examples, there may be a vertical gap or spacing between the bottom of the main wheel pocket and the top plate 924 of the switch wheel 922, such that main wheel hole and the switch wheel hole need not be perfectly aligned to allow the ball to drop to the selected launching output. In other words, the spacing between the main wheel 910 and the switch wheel 920 allow just enough space for the ball to drop within the selected tube when the switch wheel hole 902 is aligned with the tube opening, but not enough spacing to otherwise cause the ball to get stuck or jammed between the main wheel 920 and the switch wheel 920.

Similar to other examples discussed herein, when the ball change magazine is in the closed position, the main wheel may be rotated to allow selection for a particular ball in the main wheel, by aligning the associated pocket and the switch wheel hole 902 above the desired output, e.g., launching output 1402, 1404. Although FIG. 14 shows two optional launching outputs, additional launching output may be provided.

The present disclosure describes particular embodiments and their detailed construction and operation. The embodiments described herein are set forth by way of illustration only and not limitation. Those skilled in the art will recognize, in light of the teachings herein, that there may be a range of equivalents to the exemplary embodiments described herein. Most notably, other embodiments are possible, variations can be made to the embodiments described herein, and there may be equivalents to the components, parts, or steps that make up the described embodiments. For the sake of clarity and conciseness, certain aspects of components or steps of certain embodiments are presented without undue detail where such detail would be apparent to those skilled in the art in light of the teachings herein and/or where such detail would obfuscate an understanding of more pertinent aspects of the embodiments.

Figure 15:
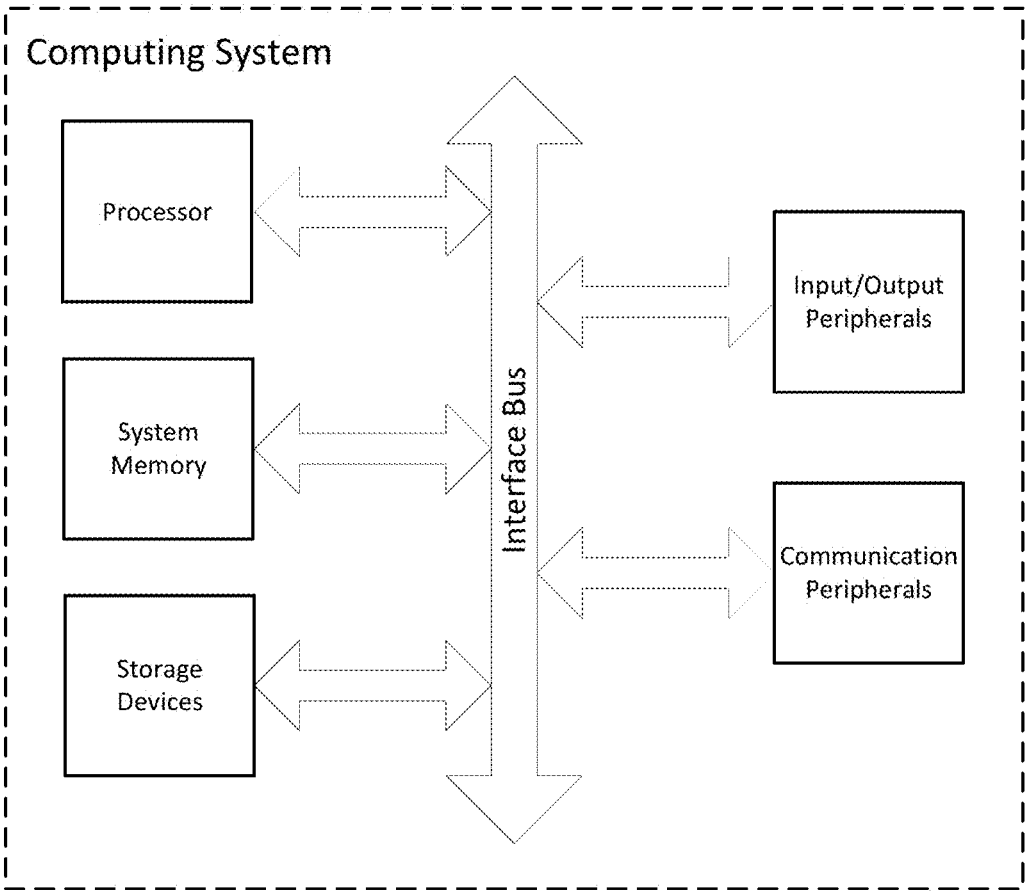
FIG. 15 is an illustration of an exemplary block diagram representing a general purpose computer system in which aspects of the methods and systems disclosed herein or portions thereof may be incorporated.

The techniques described above can be implemented on a computing device associated with a gaming device (e.g., a roulette machine operating a live roulette game), a plurality of computing devices associated with a plurality of gaming devices, a controller in communication with the gaming device(s) (e.g., a controller configured to synchronize the gaming devices(s)), or a plurality of controllers in communication with the gaming device(s). Additionally, the techniques may be distributed between the computing device(s) and the controller(s). FIG. 15 illustrates an exemplary block diagram of a computing system that includes hardware modules, software module, and a combination thereof and that can be implemented as the computing device and/or as the server.

In a basic configuration, the computing system may include at least a processor, a system memory, a storage device, input/output peripherals, communication peripherals, and an interface bus. Instructions stored in the memory may be executed by the processor to perform a variety of methods and operations, including the roulette wheel velocity adjustments and result detection optimization, as described above. The computing system components may be present in the gaming device, in a server or other component of a network, or distributed between some combinations of such devices.

The interface bus is configured to communicate, transmit, and transfer data, controls, and commands between the various components of the electronic device. The system memory and the storage device comprise computer readable storage media, such as RAM, ROM, EEPROM, hard-drives, CD-ROMs, optical storage devices, magnetic storage devices, flash memory, and other tangible storage media. Any of such computer readable storage medium can be configured to store instructions or program codes embodying aspects of the disclosure. Additionally, the system memory comprises an operation system and applications. The processor is configured to execute the stored instructions and can comprise, for example, a logical processing unit, a microprocessor, a digital signal processor, and the like.

The system memory and the storage device may also comprise computer readable signal media. A computer readable signal medium may include a propagated data signal with computer readable program code embodied therein. Such a propagated signal may take any of variety of forms including, but not limited to, electro-magnetic, optical, or any combination thereof. A computer readable signal medium may be any computer readable medium that is not a computer readable storage medium and that can communicate, propagate, or transport a program for use in connection with the computing system.

Further, the input and output peripherals include user interfaces such as a keyboard, screen, microphone, speaker, other input/output devices, and computing components such as digital-to-analog and analog-to-digital converters, graphical processing units, serial ports, parallel ports, and universal serial bus. The input/output peripherals may also include a variety of sensors, such as light, proximity, GPS, magnetic field, altitude, and velocity/acceleration. RSSI, and distance sensors, as well as other types of sensors. The input/output peripherals may be connected to the processor through any of the ports coupled to the interface bus.

The user interfaces can be configured to allow a user of the computing system to interact with the computing system. For example, the computing system may include instructions that, when executed, cause the computing system to generate a user interface and carry out other methods and operations that the user can use to provide input to the computing system and to receive an output from the computing system.

This user interface may be in the form of a graphical user interface that is rendered at the screen and that is coupled with audio transmitted on the speaker and microphone and input received at the keyboard. In an embodiment, the user interface can be locally generated at the computing system. In another embodiment, the user interface may be hosted on a remote computing system and rendered at the computing system. For example, the server may generate the user interface and may transmit information related thereto to the computing device that, in turn, renders the user interface to the user. The computing device may, for example, execute a browser or an application that exposes an application program interface (API) at the server to access the user interface hosted on the server.

Finally, the communication peripherals of the computing system are configured to facilitate communication between the computing system and other computing systems (e.g., between the computing device and the server) over a communications network. The communication peripherals include, for example, a network interface controller, modem, various modulators/demodulators and encoders/decoders, wireless and wired interface cards, antenna, and the like.

The communication network includes a network of any type that is suitable for providing communications between the computing device and the server and may comprise a combination of discrete networks which may use different technologies. For example, the communications network includes a cellular network, a Wi-Fi/broadband network, a local area network (LAN), a wide area network (WAN), a telephony network, a fiber-optic network, or combinations thereof. In an example embodiment, the communication network includes the Internet and any networks adapted to communicate with the Internet. The communications network may be also configured as a means for transmitting data between the computing device and the server.

The techniques described above may be embodied in, and fully or partially automated by, code modules executed by one or more computers or computer processors. The code modules may be stored on any type of non-transitory computer-readable medium or computer storage device, such as hard drives, solid state memory, optical disc, and/or the like. The processes and algorithms may be implemented partially or wholly in application-specific circuitry. The results of the disclosed processes and process steps may be stored, persistently or otherwise, in any type of non-transitory computer storage such as, e.g., volatile, or non-volatile storage.

In an embodiment, an automated ball-change device, comprises: a rotatable main wheel comprising a plurality of pockets, each pocket configured to receive and allow one roulette ball to pass through; a base plate positioned beneath the main wheel, the base plate comprising an open portion beneath a position of a first pocket of the plurality of pockets, and a solid portion positioned beneath the remaining pockets, wherein the solid portion prevents a roulette ball from passing through; a rotatable switch wheel positioned beneath the base plate, wherein the switch wheel comprises a solid top plate and a through hole, wherein rotation of the switch wheel causes a closed position or an position, wherein in the closed position, the solid top plate blocks the open portion of the base plate and prevents the roulette ball from passing, and wherein in the open position, the through hole aligns with the open portion to allow the roulette ball to pass through; and a controller configured to independently control a rotation of the rotatable main wheel and the rotatable switch wheel.

In the embodiment, the automated ball-change device further comprises a revolving mechanism configured to independently drive a first belt connected to the rotatable main wheel, and a second belt connected to the rotatable switch wheel.

In the embodiment, wherein the first belt is positioned around a circumference of the rotatable main wheel, and the second belt is positioned around a circumference of the rotatable switch wheel.

In the embodiment, wherein the open position aligns the through hole with a first path to a launch tube for the roulette ball.

In the embodiment, wherein the open position aligns the through hole with a second path for the roulette ball.

In the embodiment, the automated ball-change device further comprises a chute positioned above the main wheel, the chute configured to receive a plurality of roulette balls and fill the plurality of pockets one by one during the rotation of the rotatable main wheel.

In the embodiment, the automated ball-change device further comprises a first proximity sensor for detecting when the rotatable switch wheel is in the open position, and a second proximity sensor for detecting when the rotatable switch wheel is in the closed position.

The automated ball-change device of claim 1, further comprising a first sensor for detecting when the roulette ball enters a pocket of the rotatable main wheel.

In the embodiment, the automated ball-change device further comprises a launch device configured to receive the roulette ball when the switch wheel is in the open position, and a second sensor for detecting when the roulette ball is in the launch device.

In the embodiment, wherein the plurality of pockets are formed with a counter synch configured to further enable the roulette ball to enter the pocket.

In the embodiment, the automated ball-change device further comprises at least one optic sensor or proximity sensor to determine a position of the switch wheel.

In the embodiment, the automated ball-change device further comprises a sensor to determine a color of a ball within the main wheel.

In an embodiment, a method for automated ball-exchange comprises: providing a roulette ball to a first pocket of a main wheel comprising a plurality of pockets, each pocket configured to receive and allow one roulette ball to pass through when the first pocket is aligned, via rotation of the main wheel, with an open portion of a base plate positioned beneath the main wheel; determining, via a sensor, a position of the first pocket with the roulette ball; rotating the main wheel to align the first pocket with the open portion, and rotating the switch wheel; and delivering the roulette ball to a launch start position by rotating a switch wheel, positioned beneath the base plate, to an open position, wherein the switch wheel comprises a solid top plate and a through hole, and rotating the switch wheel places the switch wheel in the open position or a closed position, wherein in the closed position, the solid top plate blocks the open portion of the base plate to prevent the roulette ball from passing through, and in the open position, the through hole aligns with the open portion to allow the roulette ball to pass through.

In the embodiment, further comprising independently controlling a rotation of the rotatable main wheel and the rotatable switch wheel.

In the embodiment, further comprising controlling a timing of delivering the ball to the launch start position, based on the rotation of the main wheel and the rotation of the switch wheel.

In the embodiment, wherein the open position delivers the roulette ball to a first output path or a second, different output path.

In the embodiment, further comprising: when the switch wheel is in the closed position, receiving a plurality of roulette balls from a chute above the main wheel, and filling the plurality of pockets one by one while rotating the rotatable main wheel.

In the embodiment, further comprising sensing, via at least one proximity sensor, whether the switch wheel is in the open position or the closed position.

In the embodiment, further comprising: determining, via a sensor, that the roulette ball is in the launch start position, and launching the roulette ball to start a new game cycle.

In the embodiment, further comprising: determining, via the sensor, a color of the roulette ball; and based on the color, controlling a timing of delivering the roulette ball to the launch start position.

In an embodiment, an automated roulette machine, comprises: a roulette wheel configured to rotate in a first direction, the roulette wheel including a plurality of ball slots each configured to hold a roulette ball, the roulette wheel being configured to place a ball slot holding the roulette ball over a trap door for releasing the ball from the roulette wheel at the conclusion of a game cycle; an annular tube configured to position the roulette ball to roll around the roulette wheel during a game cycle in a second direction opposite the first direction; a launch device configured to launch the roulette ball into the annular tube to initiate the game cycle, the launch device including a propulsion assembly configured to apply a propulsion force to the roulette ball; a rotatable main wheel comprising a plurality of pockets, each pocket configured to receive the roulette ball from the trap door; a base plate positioned beneath the main wheel, the base plate comprising an open portion beneath a position of a first pocket of the plurality of pockets, and a solid portion positioned beneath the remaining pockets, wherein the solid portion prevents the roulette ball from passing through; a rotatable switch wheel positioned beneath the base plate, wherein the switch wheel comprises a solid top plate and a through hole, wherein rotation of the switch wheel causes a closed position wherein the solid top plate blocks the open portion of the base plate and prevent the roulette ball from passing, or an open position wherein the through hole aligns with the open portion to allow the roulette ball to pass through to a start position of the launch device; and a controller configured to independently control a rotation of the rotatable main wheel and the rotatable switch wheel.

In the embodiment, further comprising: a display and user interface for enabling a player to place bets during the game cycle and see results displayed at the conclusion of the game cycle.

As previously noted, the various features and processes described above may be used independently of one another or may be combined in various ways. All possible combinations and sub-combinations are intended to fall within the scope of this disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The present disclosure describes particular embodiments and their detailed construction and operation. The embodiments described herein are set forth by way of illustration only and not limitation. Those skilled in the art will recognize, in light of the teachings herein, that there may be a range of equivalents to the exemplary embodiments described herein. Most notably, other embodiments are possible, variations can be made to the embodiments described herein, and there may be equivalents to the components, parts, or steps that make up the described embodiments. For the sake of clarity and conciseness, certain aspects of components or steps of certain embodiments are presented without undue detail where such detail would be apparent to those skilled in the art in light of the teachings herein and/or where such detail would obfuscate an understanding of more pertinent aspects of the embodiments.

The terms and descriptions used above are set forth by way of illustration only and are not meant as limitations. Those skilled in the art will recognize that those and many other variations, enhancements and modifications of the concepts described herein are possible without departing from the underlying principles of the invention. The scope of the invention should therefore be determined only by the following claims and their equivalents.

What is claimed is:

1. An automated ball-change device, comprising:

a rotatable main wheel comprising a plurality of pockets, each pocket configured to receive and allow one roulette ball to pass through;

a base plate positioned beneath the main wheel, the base plate comprising an open portion beneath a position of a first pocket of the plurality of pockets, and a solid portion positioned beneath the remaining pockets, wherein the solid portion prevents a roulette ball from passing through;

a rotatable switch wheel positioned beneath the base plate, wherein the switch wheel comprises a solid top plate and a through hole, wherein rotation of the switch wheel causes a closed position or an position, wherein in the closed position, the solid top plate blocks the open portion of the base plate and prevents the roulette ball from passing, and wherein in the open position, the through hole aligns with the open portion to allow the roulette ball to pass through; and a controller configured to independently control a rotation of the rotatable main wheel and the rotatable switch wheel.

2. The automated ball-change device of claim 1, further comprising a revolving mechanism configured to independently drive a first belt connected to the rotatable main wheel, and a second belt connected to the rotatable switch wheel.

3. The automated ball-change device of claim 2, wherein the first belt is positioned around a circumference of the rotatable main wheel, and the second belt is positioned around a circumference of the rotatable switch wheel.

4. The automated ball-change device of claim 1, wherein the open position aligns the through hole with a first path to a launch tube for the roulette ball.

5. The automated ball-change device of claim 4, wherein the open position aligns the through hole with a second path for the roulette ball.

6. The automated ball-change device of claim 1, further comprising a chute positioned above the main wheel, the chute configured to receive a plurality of roulette balls and fill the plurality of pockets one by one during the rotation of the rotatable main wheel.

7. The automated ball-change device of claim 1, further comprising a first proximity sensor for detecting when the rotatable switch wheel is in the open position, and a second proximity sensor for detecting when the rotatable switch wheel is in the closed position.

8. The automated ball-change device of claim 1, further comprising a first sensor for detecting when the roulette ball enters a pocket of the rotatable main wheel.

9. The automated ball-change device of claim 8, further comprising a launch device configured to receive the roulette ball when the switch wheel is in the open position, and a second sensor for detecting when the roulette ball is in the launch device.

10. The automated ball-change device of claim 1, wherein the plurality of pockets are formed with a counter synch configured to further enable the roulette ball to enter the pocket.

11. The automated ball-change device of claim 1, further comprising at least one optic sensor or proximity sensor to determine a position of the switch wheel.

12. The automated ball-change device of claim 1, further comprising a sensor to determine a color of a ball within the main wheel.

13. The automated ball-change device of claim 12, wherein the sensor is one or more of an optic sensor, a metal sensor, a chemical sensor, a magnetic sensor and an electrical sensor.

14. A method for automated ball-exchange, comprising:

providing a roulette ball to a first pocket of a main wheel comprising a plurality of pockets, each pocket configured to receive and allow one roulette ball to pass through when the first pocket is aligned, via rotation of the main wheel, with an open portion of a base plate positioned beneath the main wheel;

determining, via a sensor, a position of the first pocket with the roulette ball;

rotating the main wheel to align the first pocket with the open portion, and rotating the switch wheel; and delivering the roulette ball to a launch start position by rotating a switch wheel, positioned beneath the base plate, to an open position, wherein the switch wheel comprises a solid top plate and a through hole, and rotating the switch wheel places the switch wheel in the open position or a closed position, wherein in the closed position, the solid top plate blocks the open portion of the base plate to prevent the roulette ball from passing through, and in the open position, the through hole aligns with the open portion to allow the roulette ball to pass through.

15. The method of claim 14, further comprising independently controlling a rotation of the rotatable main wheel and the rotatable switch wheel.

16. The method of claim 15, further comprising controlling a timing of delivering the ball to the launch start position, based on the rotation of the main wheel and the rotation of the switch wheel.

17. The method of claim 14, wherein the open position delivers the roulette ball to a first output path or a second, different output path.

18. The method of claim 14, further comprising: when the switch wheel is in the closed position, receiving a plurality of roulette balls from a chute above the main wheel, and filling the plurality of pockets one by one while rotating the rotatable main wheel.

19. The method of claim 14, further comprising: sensing, via at least one proximity sensor, whether the switch wheel is in the open position or the closed position.

20. The method of claim 14, further comprising: determining, via a sensor, that the roulette ball is in the launch start position, and launching the roulette ball to start a new game cycle.

21. The method of claim 14, further comprising: determining, via the sensor, a color of the roulette ball; and based on the color, controlling a timing of delivering the roulette ball to the launch start position.

22. The method of claim 21, wherein the sensor is one or more of an optic sensor, a metal sensor, a chemical sensor, a magnetic sensor and an electrical sensor.

23. An automated roulette machine, comprising:

a roulette wheel configured to rotate in a first direction, the roulette wheel including a plurality of ball slots each configured to hold a roulette ball, the roulette wheel being configured to place a ball slot holding the roulette ball over a trap door for releasing the ball from the roulette wheel at the conclusion of a game cycle;

an annular tube configured to position the roulette ball to roll around the roulette wheel during a game cycle in a second direction opposite the first direction;

a launch device configured to launch the roulette ball into the annular tube to initiate the game cycle, the launch device including a propulsion assembly configured to apply a propulsion force to the roulette ball;

a rotatable main wheel comprising a plurality of pockets, each pocket configured to receive the roulette ball from the trap door;

a base plate positioned beneath the main wheel, the base plate comprising an open portion beneath a position of a first pocket of the plurality of pockets, and a solid portion positioned beneath the remaining pockets, wherein the solid portion prevents the roulette ball from passing through;

a rotatable switch wheel positioned beneath the base plate, wherein the switch wheel comprises a solid top plate and a through hole, wherein rotation of the switch wheel causes a closed position wherein the solid top plate blocks the open portion of the base plate and prevent the roulette ball from passing, or an open position wherein the through hole aligns with the open portion to allow the roulette ball to pass through to a start position of the launch device; and a controller configured to independently control a rotation of the rotatable main wheel and the rotatable switch wheel.

24. The automated roulette machine of claim 23 further comprising: a display and user interface for enabling a player to place bets during the game cycle and see results displayed at the conclusion of the game cycle.

* * * * *